US007857548B2

(12) United States Patent
Schroeder

(10) Patent No.: US 7,857,548 B2
(45) Date of Patent: Dec. 28, 2010

(54) BARRIER PANEL SYSTEM AND METHOD OF INSTALLING

(76) Inventor: Mark Schroeder, 1566 Sutherland Ct., Concord, CA (US) 94521

( * ) Notice: Subject to any disclaimer, the term of this patent is extended or adjusted under 35 U.S.C. 154(b) by 427 days.

(21) Appl. No.: 11/877,581

(22) Filed: Oct. 23, 2007

(65) Prior Publication Data

US 2009/0016821 A1 Jan. 15, 2009

Related U.S. Application Data

(60) Provisional application No. 60/949,466, filed on Jul. 12, 2007.

(51) Int. Cl.
*E02B 7/02* (2006.01)

(52) U.S. Cl. ..... 405/116; 405/274; 256/24

(58) Field of Classification Search ..... 405/107, 405/110, 111, 116, 274; 175/19, 21
See application file for complete search history.

(56) References Cited

U.S. PATENT DOCUMENTS 6,568,881 B2 5/2003 Long
7,341,402 B1 3/2008 Schroeder
2005/0163575 A1 7/2005 Dagher et al.

*Primary Examiner*—Tara Mayo-Pinnock
(74) *Attorney, Agent, or Firm*—Fliesler Meyer LLP

(57) ABSTRACT

A barrier panel system and a method of installing the barrier panel system is provided. The barrier panel system includes a barrier panel having a top and a bottom. The panel includes at least one channel extending from the top to the bottom of the barrier panel. A removable jet assembly unit can be connected to the panel within the channel. The removable jet assembly unit includes at least one cutter tool pipe which is connected to a jet head and at least one vacuum manifold. The jet head at the bottom of the cutter tool pipe delivers and directs the pressurized stream to transform the ground material into a form which is easily removable by a vacuum connected to the vacuum manifold. As the vacuum removes the ground matter, an opening is formed in the ground allowing the panel to sink. The barrier panel also includes interlocking features on the sides allowing them to be easily attached to one another horizontally to form an interconnected barrier wall system.

21 Claims, 7 Drawing Sheets

BARRIER PANEL SYSTEM AND METHOD OF INSTALLING

STATEMENT OF RELATED APPLICATION

The present application claims the benefit of priority under 35 U.S.C. §119(e) to U.S. Provisional Patent Application entitled "Barrier Panel System and Method of Installing," Application No. 60/949,466, filed on Jul. 12, 2007, which application is incorporated herein by reference. The present application is also related to U.S. patent application Ser. No. 11/099,202 filed Apr. 4, 2005, now U.S. Pat. No. 7,341,402, issued on Mar. 11, 2008 in the name of inventor Mark Schroeder entitled "Barrier Panel," which is incorporated by reference herein.

FIELD OF THE INVENTION

The subject matter described herein relates to construction panels in general. More particularly, the subject matter relates to modular based in-ground barrier panels.

BACKGROUND

Levees provide protection from flooding in communities, including industrial, commercial, residential, and agricultural communities. However, should a levee break, extreme damage to the surrounding communities can occur. Levee failures can result from erosion, slides within the levee embankment or the foundation soil, or from animals burrowing into the levee. As one example, beavers dug into a levee in the California Delta, flooding crops and farm communities with water. Damages and cleanup costs were estimated at $90 million dollars.

Farming on the lands also scrapes away layers of soil, gradually pushing the land below sea level or below a natural water table in a process called subsidence. As the land falls below sea level, additional pressure is placed on the levees to control flooding of the lands. Continual subsidence occurs due to ongoing soil placement on the levees in order for the levee elevation to be maintained. This additional soil placement causes increased loading of the toe of the existing levees inducing potential failure of the levee.

Should multiple levees collapse from tidal fluctuations or seismic events, farms, homes and crops would be flooded, and rail lines, gas pipelines and aqueducts could be damaged. Water quality may even be significantly compromised and the ecosystem of neighboring plants and animals may be endangered.

To maintain levees, the current practice on the water side is to buttress the slope with soil and rock, called riprap, to protect the levee against buffeting by wind-whipped waves and the force of winter high tidal conditions. However, the rocks and soil add weight to the levee, which causes the levee to subside. This repeated addition of rocks or soil every few years exacerbates subsidence and increases maintenance costs to governmental agencies.

Alternative measures used to reinforce levees are Fiberglass Reinforced Polymer (FRP) sheet piling. However, the FRP must be put into levees using vibratory hammers, or dynamically driven using a removable mandrill. Unfortunately, most levees are built in flood prone areas or of basic compressible soil that was laid down in a stratified manner. The introduction of water pressure through the layered soil reduces the levee strength making it susceptible to failure from strong vibrations. Furthermore, homes built next to the levees may become damaged due to the vibrations.

Levees may also be reinforced with steel, concrete, or cement barriers. These types of installations would require the use of vibrational or hydraulic driving equipment. In general, large heavy equipment must be used to install these types of barrier systems. In many cases, the levees are unable to support the additional equipment loads and accessibility on the levees is typically limited. All of this serves to increase the expense of installing barriers in levees. Furthermore, these barriers may be prone to corrosion with the exception of concrete. All of these barriers are labor intensive during installation. In addition, these barrier systems require heaving installation equipment, limiting the accessibility on the levee.

What is needed is a barrier system which is easily installable, which does not need to be driven into the ground, and which includes modular barrier components which are interlocking.

BRIEF DESCRIPTION OF THE DRAWINGS

The accompanying drawings, which are incorporated into and constitute a part of this specification, illustrate one or more embodiments and, together with the detailed description, serve to explain the principles and implementations of the invention. In the drawings.

DETAILED DESCRIPTION

Embodiments are described herein in the context of a barrier panel system and method of installing the panel. Those of ordinary skill in the art will realize that the following detailed description is illustrative only and is not intended to be in any way limiting. Other embodiments of the present invention will readily suggest themselves to such skilled persons having the benefit of this disclosure. Reference will now be made in detail to implementations of embodiment of the present invention as illustrated in the accompanying drawings. The same reference indicators will be used throughout the drawings and the following detailed description to refer to the same or like parts.

The system and method described relates to a barrier panel system which may include modular barrier walls, a cutting tool, and a vacuum. The modular barrier walls are installed in the ground through the use of a cutting tool and a vacuum. It should be noted that although the barrier panel system is described herein in terms of being installed to fortify a levee, it is contemplated that the system may be installed for any purpose, including, but not limited to, fortifying a hill side, laying a foundation of a building, constructing an underground garage or basement, and any other purpose envisioned by one of ordinary skill in the art having the benefit of this disclosure.

A barrier panel system and a method of installing the barrier panel system is provided. The barrier panel system includes a panel with at least one channel extending from the top to the bottom. A removable jet assembly unit can be connected to the panel within the channel. The removable jet assembly unit includes at least one cutter tool pipe which is connected to a jet head and at least one vacuum manifold. The jet head delivers and directs the pressurized stream at the bottom of the panel. The pressurized stream transforms the ground material into a form which is easily removable by the vacuum. As the vacuum removes the ground matter, an opening is formed in the ground which allows the panel to sink into the ground quickly and effectively. The barrier panel also includes interlocking features on its sides which allow multiple barrier panels to be easily attached together horizontally to form an interconnected barrier wall system.

Figure 1:
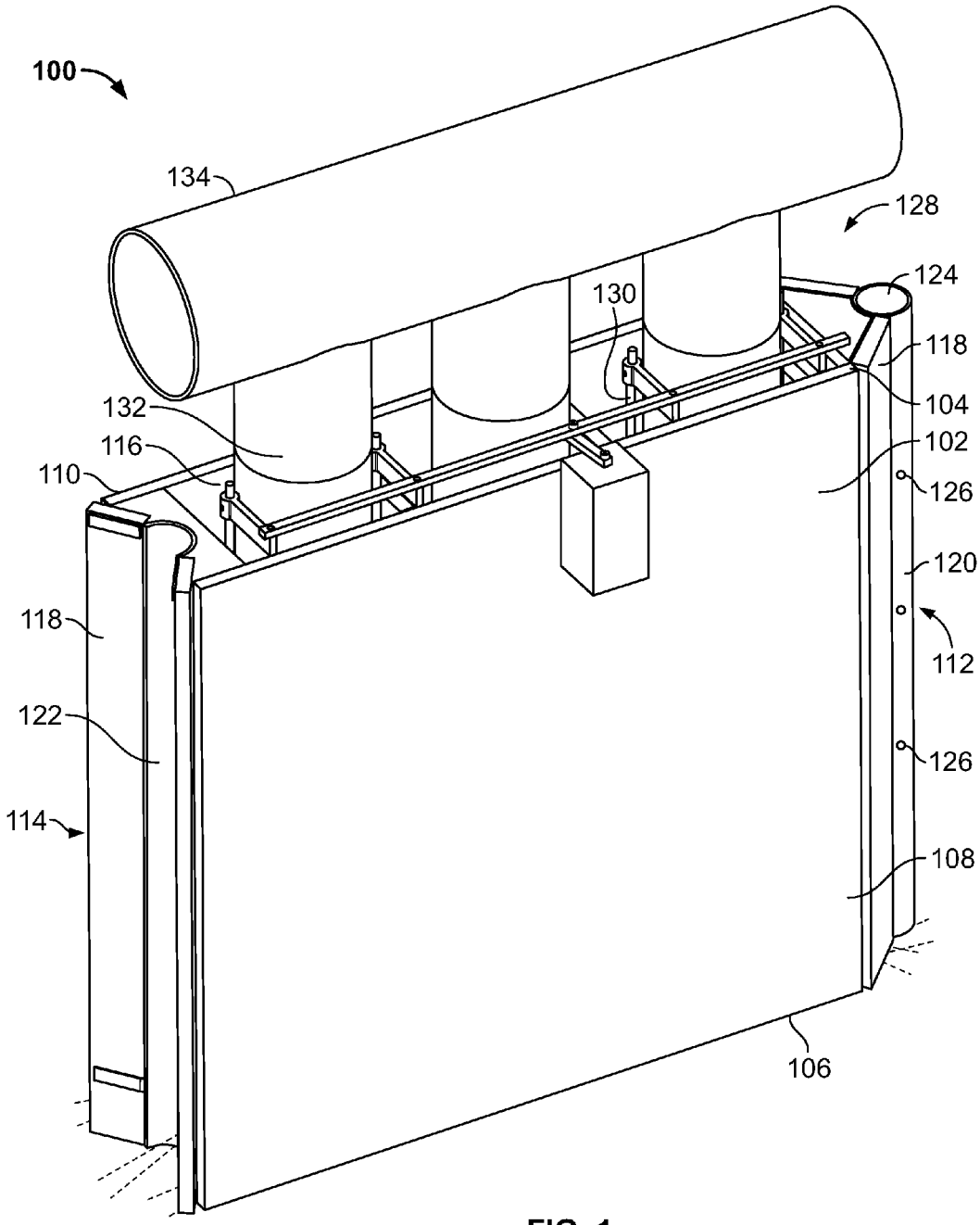
FIG. 1 illustrates an embodiment of the barrier panel system.

FIG. 1 illustrates an embodiment of the barrier panel system. The barrier panel system, generally numbered 100, includes a panel 102 having a top 104, a bottom 106, a front face 108, a back face 110, a side attachment member 112, a corresponding side mating member 114, and channels 116 extending from the top 104 to the bottom 106 of the barrier panel 102. It is noted that the channels 116 in this embodiment are vertically oriented, however the channels may be oriented horizontally, diagonally or a combination thereof. It is also noted that the barrier panel system 100 can include one or more channels 116.

The side attachment member 112 and the corresponding side mating member 114 allow the panels 102 to be coupled to one another to form a composite barrier wall. The side attachment member 112 and the corresponding side mating member 114 may be beveled to allow the panels to be positioned at any angle necessary to provide for rigidity, surface obstructions, or surface changes in the ground. The panels in the composite barrier wall can be connected to each other by any means such as adhesives, screws, bolts, or other similar materials.

In an embodiment, the side attachment member 112 includes side faces 118 which taper at an angle toward a cylindrical lock 120 (e.g., a cylindrical pipe). The corresponding side mating member 114 also includes side faces 118 which taper in toward a receiving notch 122. The receiving notch 122 receives a corresponding cylindrical lock 120 of another panel and forms an interlock with the adjacent panel 102. The use of a side attachment member 112 and a corresponding side mating member 114 allows horizontally attached panels 102 to be oriented at an angle with one another. The diameter of the receiving notch 122 may be slightly larger than the diameter of the cylindrical lock 120 to help facilitate the interlock.

In an embodiment, the cylindrical lock 120 includes a top aperture 124, without a corresponding bottom aperture, for receiving cement, grout, concrete or other bonding mixture injected therein. The cylindrical lock 120 may also include various lock apertures 126 along the outer or side surface of the cylindrical lock 120 to allow the bonding mixture to discharge out of the cylindrical lock 120 and fortify the connection between the cylindrical lock 120 and a corresponding receiving notch 122.

The panels 102 may be made of any suitable material, including concrete, steel, fiberglass or other material. In one embodiment, the panel 102 is made of a polypropylene material. Although illustrated in a generally rectangular shape, the panel 102 may be formed in any shape necessary. Similarly, the channels 116 are illustrated in a generally rectangular shape, but may also be formed in any shape necessary. It is noted that the panel 102 may have any combination of length, width and height dimensions as envisioned by one having an ordinary skill in the art having the benefit of this disclosure.

Referring still to FIG. 1, an embodiment of the barrier panel system 100 may also include a jet assembly unit, generally numbered 128. The jet assembly unit 128 includes a cutting tool having a pipe 130, a jet head connected to the pipe 130 (shown in FIG. 2), a vacuum manifold 132 and a connecting manifold 134. The channels 116 within the panel 102 allow the jet assembly unit 128 to be inserted therein, whereby the cutting tool of the jet assembly unit 128 cuts through the ground matter at the bottom end 106 of the panel 102. In one embodiment, the cutting tool includes at least one cutting tool pipe 130 which injects a pressurized stream onto the ground matter to effectively cut through the ground matter. The pressurized stream may include a stream of pressurized fluid, a stream of pressurized air, or a combination of both. It is contemplated that other cutting tools, such as a drill, can be used instead of the pressurized pipes to affect removal of the ground matter. As the ground matter is cut away, the vacuum manifold 132 removes the affected ground matter.

Figure 2:
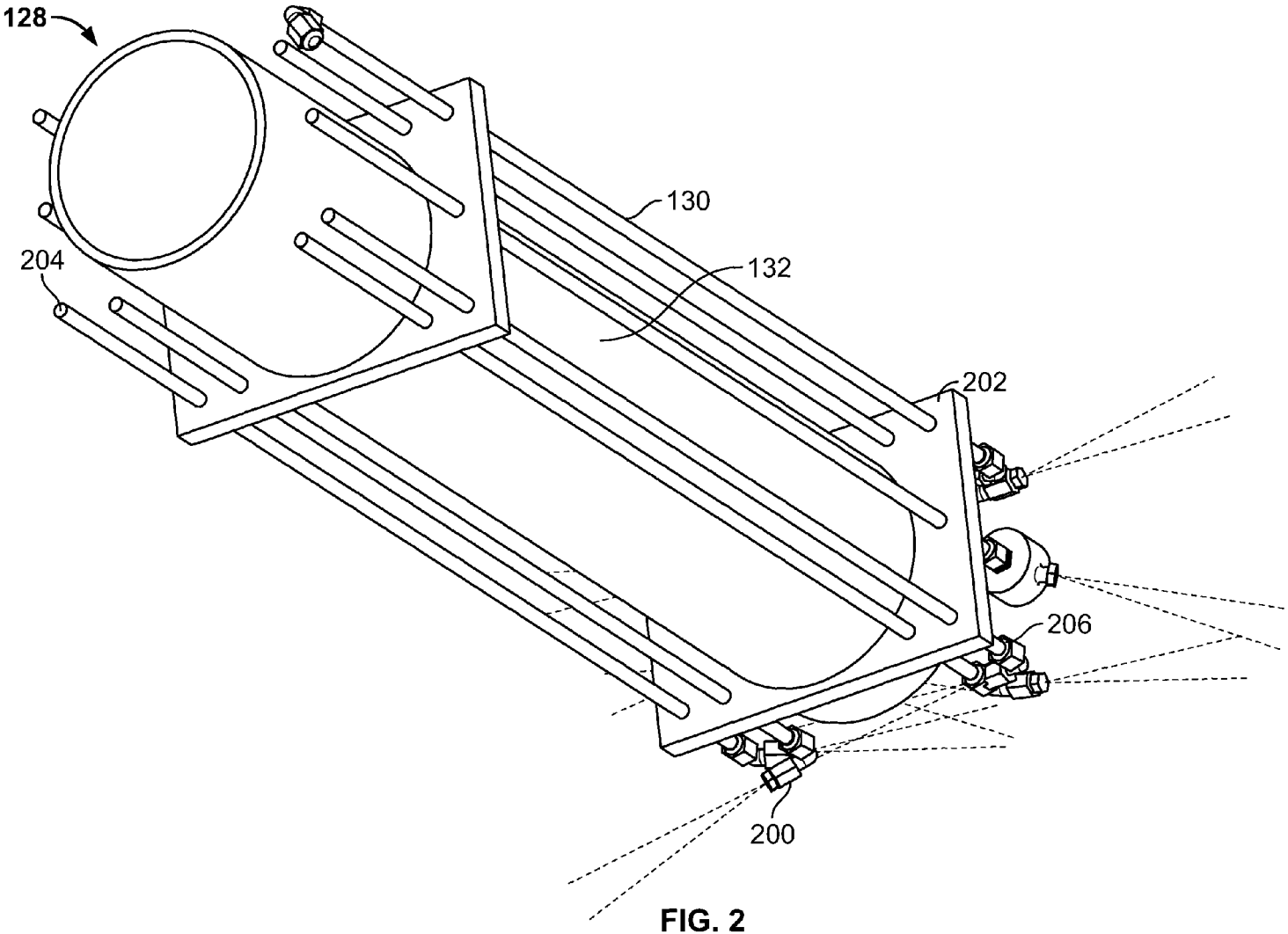
FIG. 2 illustrates an embodiment of the jet assembly unit of the barrier panel system.

FIG. 2 provides an illustration of an embodiment of the jet assembly unit 128. The jet assembly unit 128 includes a plurality of cutter tool pipes 130, a vacuum manifold 132, jet heads 200 connected to the cutter tool pipes 130, and connector members 202. The cutter tool pipes 130 have a first end 204 and a second end 206. The first end 204 is open for connection to a pressurized stream source at and/or near the top of the panel. The pressurized stream may include a stream of pressurized fluid, a stream of pressurized air, or a combination of both. The second end 206 of the cutter tool pipes 130 are connected to jet heads 200 which delivers and directs the pressurized stream at and/or near the bottom of the panel to affect ground matter.

The pressurized stream forced out of the jet heads 200 contacts the ground material and effectively cuts away the ground material. It should be noted that the pressurized stream does not liquefy the ground material, but instead affects the ground matter to allow the material to be easily removed, as described below. In an embodiment, the pressurized stream wets the ground matter. In an embodiment, the pressurized stream merely breaks up the ground matter to be easily removable. Although the pressure of the pressurized stream will depend on the material composition of the ground matter, the pressure of the pressurized stream may be about 5000 psi if the ground matter includes peat material. It should be noted that other pressures up to 20,000 psi are contemplated for the pressurized stream.

The cutter tool pipes 130 and the jet heads 200 can have either fixed or mobile configurations. When in a mobile configuration, the cutter tool pipes 130 may be allowed to move in a manner that best facilitates the cutting process. Accordingly, a mobile cutter tool pipe 130 may be directed to move from side to side, up and down, be directed to rotate about an axis, or any combination thereof while delivering the pressurized stream. When in a fixed configuration, the cutter tool pipe 130 is immobile while delivering the pressurized stream. When the jet heads 200 are in a mobile configuration, the jet heads 200 are allowed to move while delivering the pressurized stream, e.g., rotate about a central axis transverse to the longitudinal axis of the cutter tool pipe 130. When the jet heads 200 are in a fixed configuration, the jet heads 200 deliver the pressurized stream in a stationary position. In both a fixed configuration and a mobile configuration, the jet heads 200 may have a single opening or a plurality of openings. The jet heads 200 may be L-shape, disk-shaped, or have any other shape that best allows the jet heads to deliver the pressurized stream to cut the ground matter.

Figure 3:
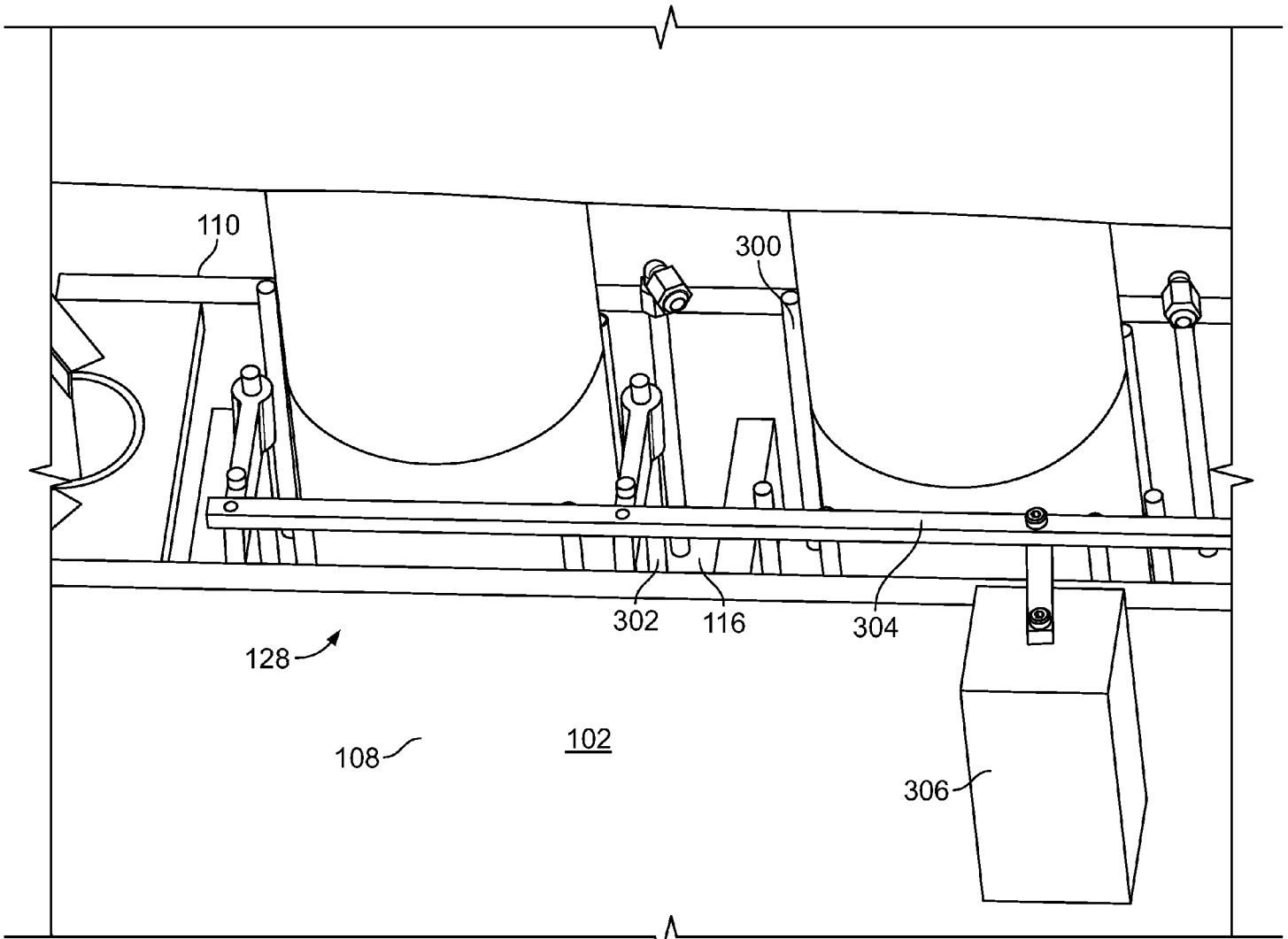
FIG. 3 illustrates a top peripheral view of the barrier panel system of FIG. 1.
Figure 4:
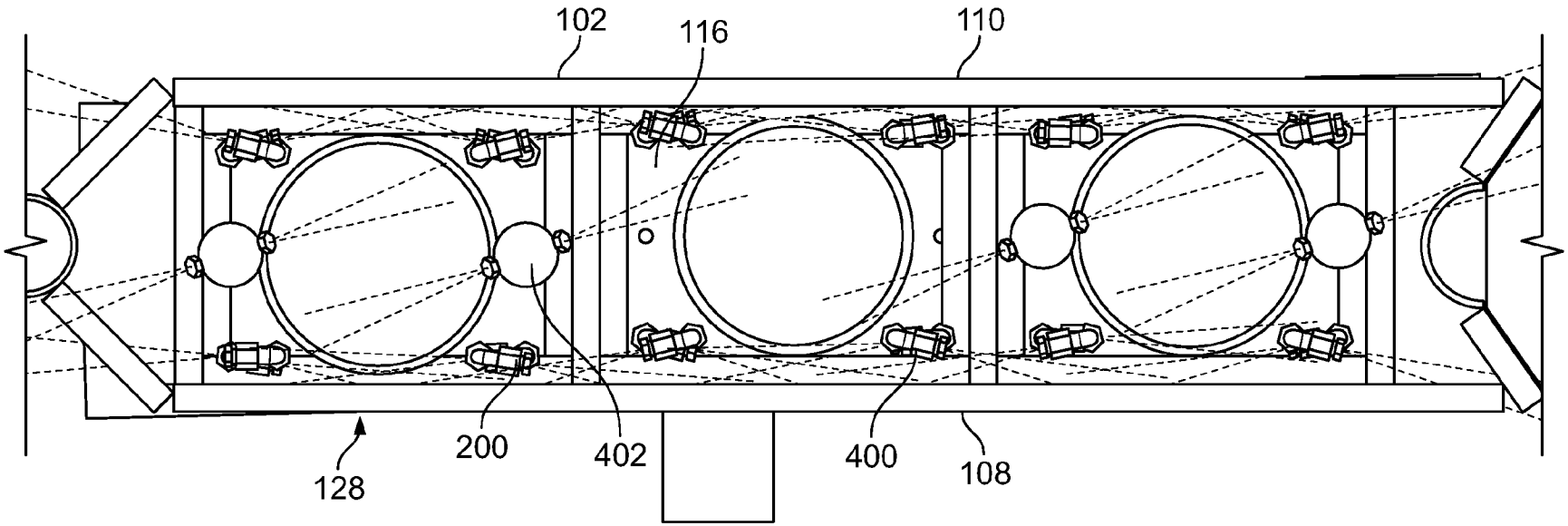
FIG. 4 illustrates a bottom view of the barrier panel system of FIG. 1.

FIGS. 3 and 4 provide further illustrations of an embodiment of the jet assembly unit. Referring now to FIG. 3, FIG.

3 illustrates the top or upper portion of the jet assembly unit 128 installed within the channels 116 of a panel 102. The cutter tool pipes 130 (shown generally in FIG. 2) can have fixed or mobile configurations. In one embodiment, the outer cutter tool pipes 300 are positioned around the perimeter of the panel 102, next to the front face 108 and the back face 110 of the panel, and have a fixed configuration. The inner cutter tool pipes 302 are positioned approximately halfway between the front face 108 and the back face 110 of the panel 102 in close proximity to the perimeter of the channel 116. The inner cutter tool pipes 302 in this embodiment have a mobile configuration and are pivotally connected to an arm unit 304 which is pivotally connected to an actuator 306. The actuator 306 is attached to the panel 102 and can be removed once the panel 102 is installed. The actuator 306 causes the arm unit 304 to oscillate back and forth, thereby causing the inner cutter tool pipes 302 to rotate back and forth about a central axis. This rotation of the inner cutter tool pipes 302 allow the jet heads connected to the inner cutter tool pipes 130 to oscillate while delivering the pressurized stream. Other means can be used to rotate or otherwise move either the outer cutter tool pipes 300 or the inner cutter tool pipes 302 as envisioned by one of ordinary skill in the art having the benefit of this disclosure.

FIG. 4 illustrates the bottom portion of an embodiment of the jet assembly unit installed within the channels 116 of a panel 102. The jet assembly unit 128 includes a plurality of jet heads 200 (shown generally in FIG. 2) which are connected to cutter tool pipes 130 (shown generally in FIG. 2). In one embodiment, outer jet heads 400 having a fixed configuration are positioned around the perimeter of the panel 102 in close proximity to the front face 108 and the back face 110 of the panel. The outer jet heads 400 are directed toward the nearest panel wall at an angle. In this embodiment, the channels 116 are rectangular in shape, and the outer cutter tool pipes 300 (as shown in FIG. 3) connected to the outer jet heads 400 are positioned at the corners of the channel 116. The outer jet heads 400 are angled to deliver the pressurized stream to affect the ground matter in the immediate vicinity of the panel walls, thereby defining the perimeter of the area to be cut beneath the panel and ensuring that the ground material around the perimeter of the panel is affected and/or cut. In another embodiment, the outer jet heads 400 can have a mobile configuration. It should also be noted that the channels 116 may have any shape, and the jet heads can be positioned at any location within the channel 116.

In this embodiment, inner jet heads 402 are positioned halfway between the front face 108 and the back face 110 of the panel 102 in close proximity to the perimeter of the channel 116. In one embodiment, the inner jet heads 402 have mobile configurations and are connected to cutter tool pipes having fixed configurations, wherein the jet heads rotate freely from the pressure of the pressurized stream about a central axis transverse to the longitudinal axis of the cutter tool pipe as the pressurized stream is delivered. In another embodiment, the inner jet heads 402 have fixed configurations while the inner cutter tool pipes 302 (as shown in FIG. 3) have mobile configurations wherein the inner cutter tool pipes 302 are rotated back and forth about a central axis, the rotation of the central cutter tool pipes 302 allowing the connected central jet heads 402 to oscillate back and forth while delivering the pressurized stream.

Referring back to FIG. 2, the vacuum of the jet assembly unit 128 may be applied using a vacuum manifold 132 which is used in removing the affected ground matter from the ground. A vacuum force is applied through the vacuum manifold 132, but is kept separate from the pressurized stream delivered in the cutter tool pipes 130. This configuration allows the pressurized stream to be delivered to the ground uninterrupted from the vacuum force being applied in the opposite direction. Upon the pressurized stream being forced into the ground matter, the affected ground matter is removed through the vacuum manifold 132. The vacuum force may be generated by a vacuum source (not shown) which is coupled to the vacuum manifold 132.

As the cutting tool delivers the pressurized stream which affects the ground matter, the vacuum source removes the affected ground matter to form an opening, cavity, or pathway in the ground matter with substantially the same relative dimensions as the barrier panel. In other words, the panel 102, through use of the cutting tool, cuts the ground matter to reduce the strength of the ground matter in the immediate vicinity of the panel 102. The panel 102 thus removes the affected ground matter to eliminate pore pressure in the surrounding soil. The removal of the ground matter from under the panel 102, along with the weight of the panel 102, causes an effect swap between the panel 102 and the removed ground matter. If the weight of the panel 102 is insufficient to cause the panel to sink in the opening created, minimal force can be applied to push the panel 102 down. This procedure, in effect, allows the panel 102 to effectively and quickly be installed into the ground without unnecessarily disturbing the ground matter outside the vicinity of the panel 102. Further, this procedure allows for a safer and more efficient way to insert panels into the ground matter without the use of a pile driver or vibratory hammers.

In one embodiment, a pressurized stream is applied in each of the channels 116. Alternatively, a pressurized stream can be applied to less than all, including only one, channel 116. The pressurized stream can be selectively applied in one or more of the channels 116 at any given time when it is observed that one end of the panel is being lowered into the ground at a faster rate than the opposite end. In such an example, the rate of the pressurized stream is decreased at the faster descending end and/or the rate of the pressurized stream at the slower descending end is increased. Alternatively or additionally, the amount of pressure in the pressurized stream is decreased at the faster descending end and/or the amount of pressure in the fluid at the slower descending end is increased. This may be automatically adjusted using computer system controls to regulate the rate of the pressurized stream or the amount of pressure in the pressurized stream supplied to the cutting tool, whereby ground sensors provide feedback to the computer system.

Referring back to FIG. 1, in an embodiment, the vacuum manifolds 132 within the channels 116 may be connected to other channel vacuum manifolds 132 using connector manifold 134. The connector manifold 134 attaches the channel vacuum manifolds 132 to the vacuum source.

In one embodiment, the side of the vacuum manifold 132 can be opened to expose the interior of the vacuum manifold 132. The vacuum manifold 132 interior is then sealed closed when in use to allow proper vacuum pressure to be applied within. In one embodiment, the vacuum manifolds 132 include one or more observation windows to allow viewing the affected ground matter as it is extracted through the channels 116 of the panel 102 into the vacuum manifold 132. The observation windows allow the installer to examine the ground matter extracted while the panel 102 is being installed. The installer is thus able to effectively determine whether to increase or decrease fluid and/or vacuum pressure based on the examined affected ground matter as well as for other purposes. In one embodiment, the side of the vacuum manifold 132 has a door which may be selectively opened to allow access to the interior of the vacuum manifold 132.

Referring again to FIG. 2, an embodiment of the jet assembly unit 128 also includes connecting members 202. In one embodiment, the connecting members 202 are flat platforms. The flat platform connecting members 202 can be configured to secure the cutting tool pipes 130 and the vacuum manifold 132 in place within the channel. The connecting member 202 can also be configured to have large pipe openings to allow some or all of the cutter tool pipes 130 to rotate about a central axis as well as allow some or all of the cutter tool pipes 130 to be moved up or down as the pressurized stream is being delivered. It is envisioned that one or more connecting members 202 may be used. In alternative embodiments, the connector member 202 may vary from a support plate and can include any other connector that allows a cutting tool and a vacuum to extend into the channel within the panel, such as a Y-connector or a quick connect coupler. The connector member 202 may be made out of any appropriate material including, but not limited to plastic, steal, metal, or polypropylene material.

Figure 5:
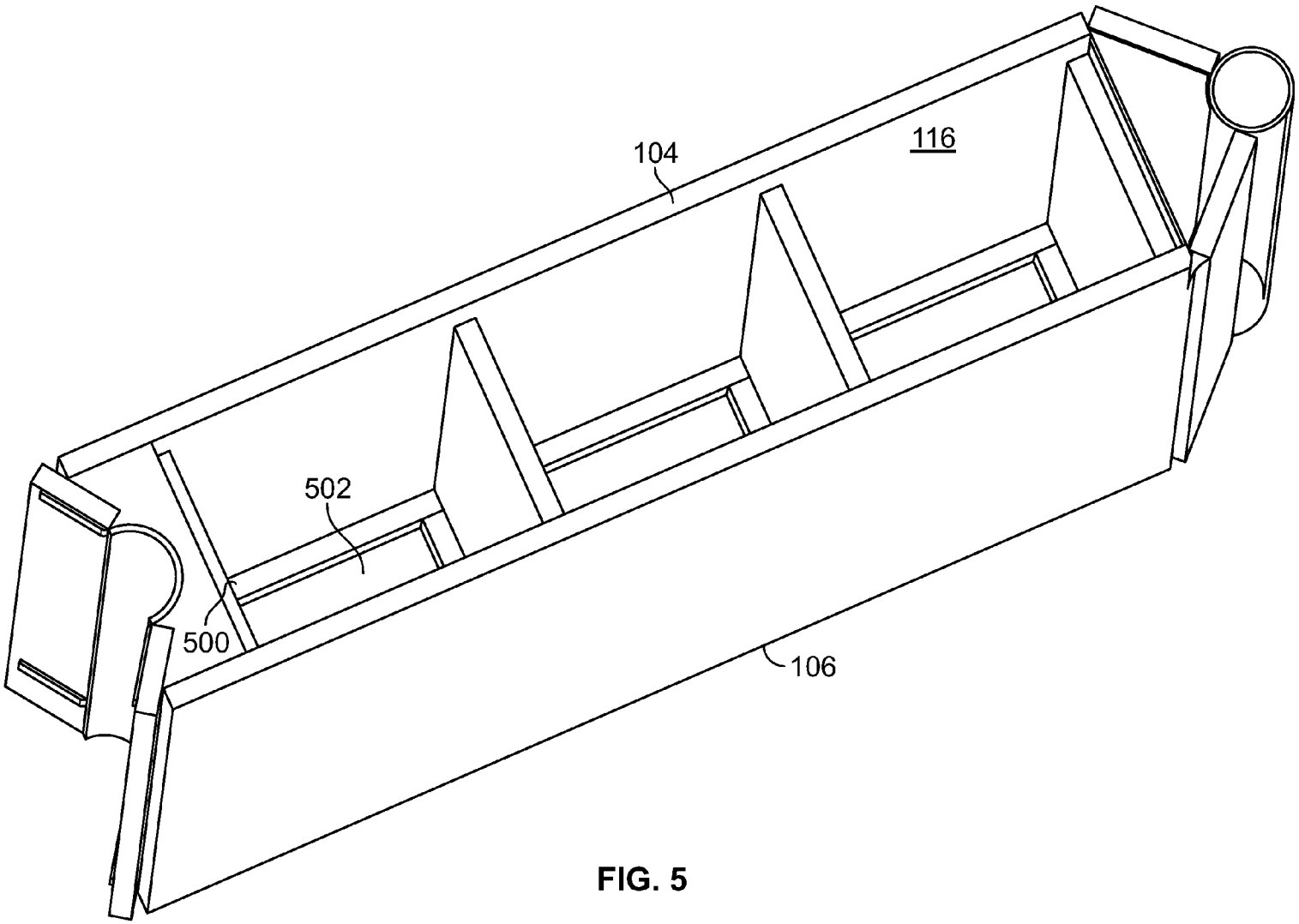
FIG. 5 illustrates the barrier panel of the barrier panel system of FIG. 1.
Figure 6:
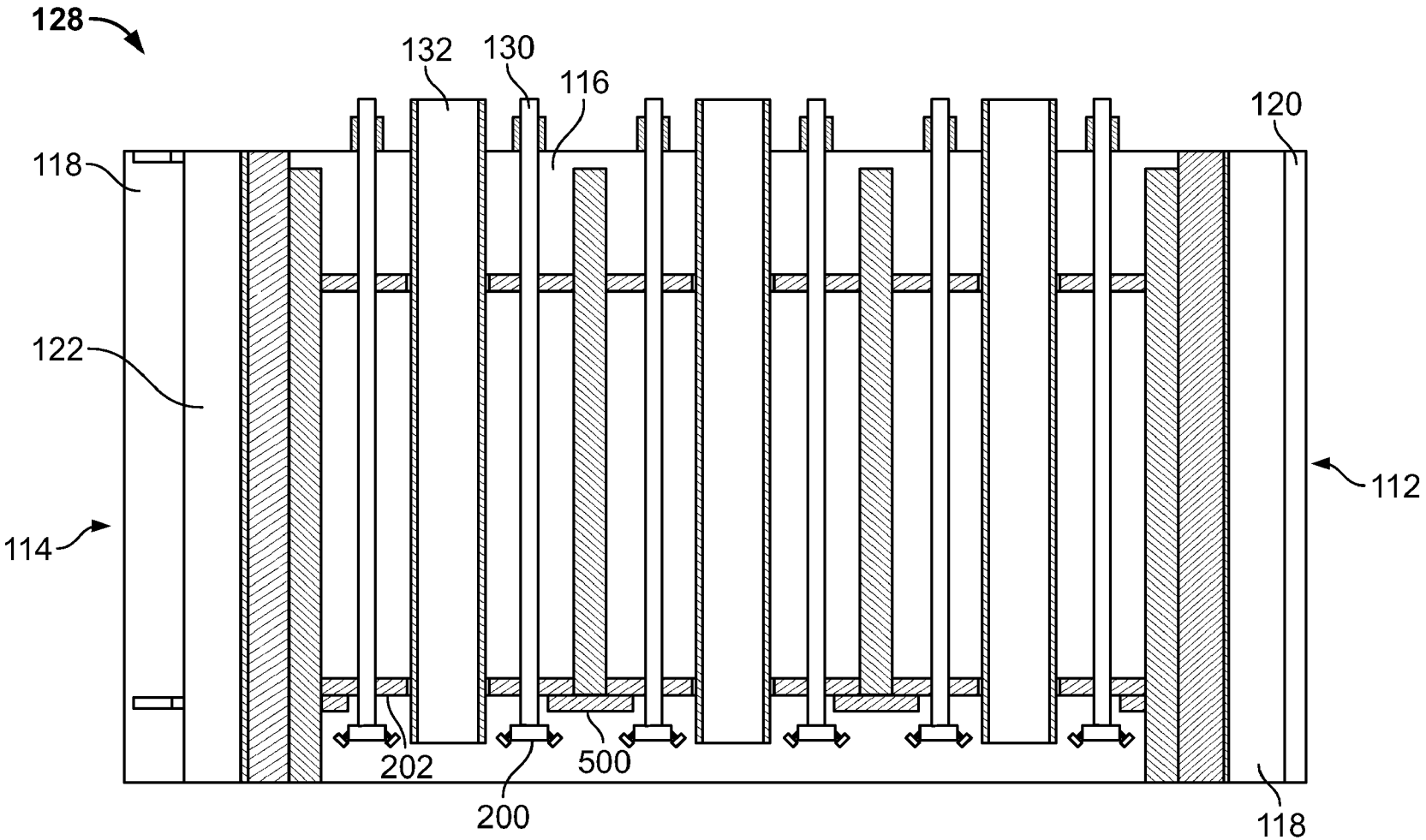
FIG. 6 illustrates a cross-sectional front view of the barrier panel system of FIG. 1.

Referring now to FIGS. 5 and 6, it can be seen that in an embodiment of the panel 102, the channel 116 further includes a floor 500 having an aperture 502 in the channel floor. The channel floor 500 may be used to support the jet assembly unit 128 (shown in FIG. 2) within the channel 116. The channel floor 500 in one example is positioned preferably about 6 inches from the bottom of the panel 106, however, it is noted that the channel floor 500 may have any height within the channel 116. In an embodiment, the flat platform connector member 202 may be placed on top of the channel floor 500 as illustrated in FIG. 6. The channel floor aperture 502 allows the cutter tool pipes 130 and the vacuum manifold 132 to extend below the channel floor 500 to affect the ground matter while the channel floor 500 supports the flat platform connector member 202, thereby supporting the jet assembly unit 128 within the channel.

The panel 102 may be positioned in any part of the levee. In one example, by positioning the regaining wall in the center of the levee, burrowing animals will less likely be able to break the levee. The burrowing animals can remove some material from the levee, but the panel will provide a barrier to limit damage to the levee. It should be noted that although the panel is described for installing in a levee, the panel may be installed in any ground area where protection from ground material erosion or shifting is desired.

In another embodiment, the panel 102 may be formed in the shape of a "T" to retrofit the ground (e.g., levee) to withstand earthquakes. Attachment members may be attached to the back of the panel 102 to form the "T" shape. The "T" shaped panel may be positioned on the edge of the levee or at any position necessary to provide reinforcement to the levee. Alternatively, the panels 102 may be positioned on both sides of the levee. In another embodiment, the levee may be reinforced with barrier panels 102 on both sides of the levee and with panels 102 in the center of the levee. It should be noted that although the above example is described in terms of installing the panel in a levee, the panel may be installed in any ground. As a further alternative, the panel can have an "I" shape similar to an I-beam, or similar "H" shape to provide improved anchorage in the ground. Other alternatives, such as an "L" shape, can likewise be used depending on desired retaining properties.

In another embodiment, a panel 102 may be placed onto another panel 102 which is already installed in the ground matter. The two panels 102 may be connected to one another by any means such as adhesives, screws, bolts, or other similar materials. In addition, the upper panel 102 is lined up with the lower panel 102 such that the channels 116 of the upper panel 102 line up and are in communication with the channels 116 of the lower panel 102. Upon the lower panel 102 being installed into the ground, and the upper panel 102 being securely placed on top of the lower panel 102, bonding material (e.g., cement, grout, concrete) is injected into the channels 116 of the upper panel 102. Considering the upper panel channels 116 are in communication with the lower panel channels 116, the bounded material will also travel and fill up the lower panel channels 116, thereby securing and fortifying the upper panel 102 to the lower panel 102.

Figure 7:
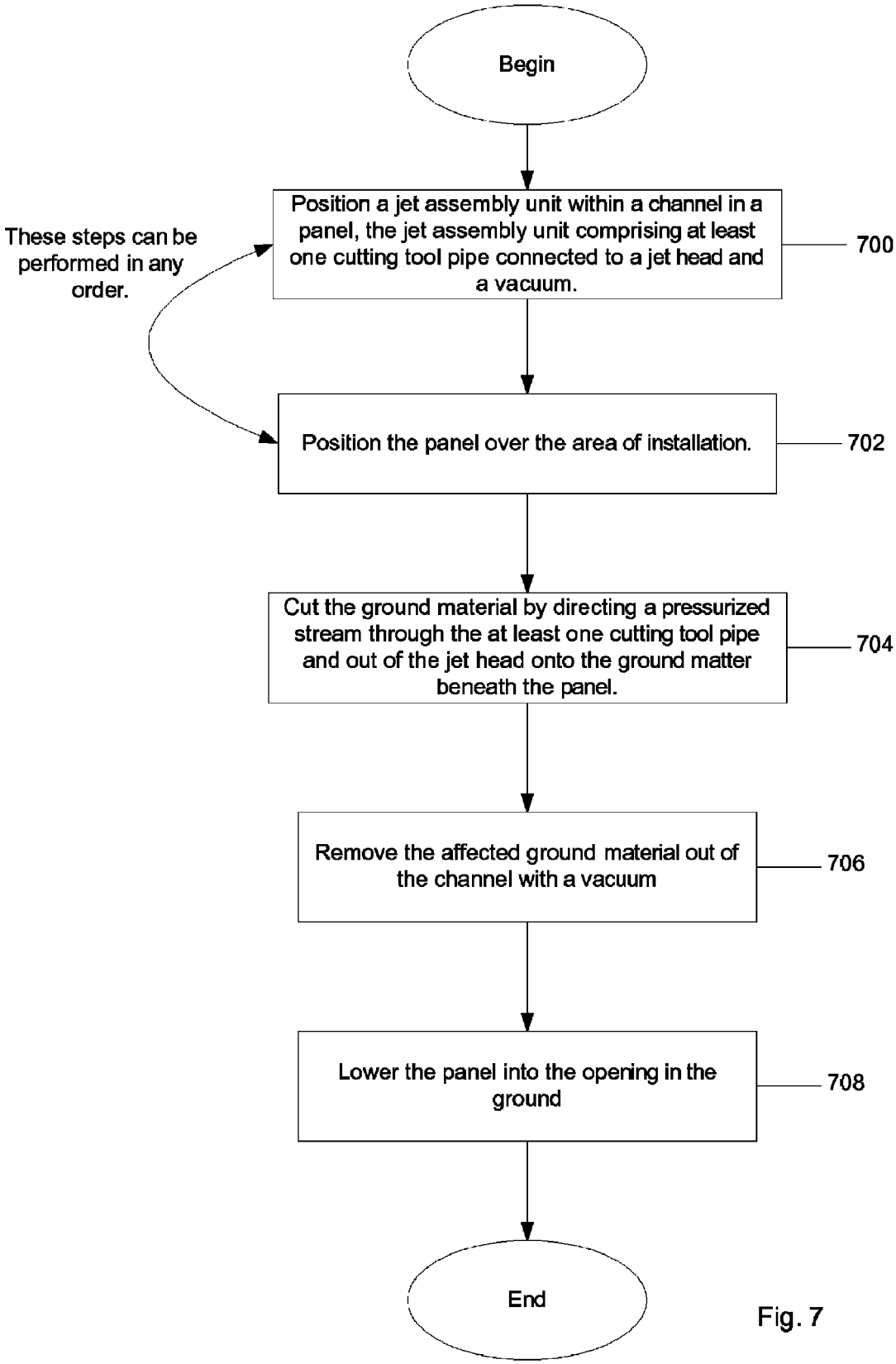
FIG. 7 is a flow chart illustrating a method for installing the barrier panel in accordance with an embodiment.

FIG. 7 illustrates a method for installing a retaining wall having a plurality of barrier panels in accordance with some embodiments of the present invention. The structural embodiments of the barrier panel system are discussed above. As shown in FIG. 7, a jet assembly unit, including a cutting tool and vacuum, is removably positioned within a channel in a panel (700). Once the jet assembly unit is positioned within the panel, the barrier panel system is positioned over the area of installation (702). These two steps may be performed in any order.

Once the jet assembly unit is positioned within the channel and the barrier panel system is positioned over the area of installation, the cutting tool having a cutting tool pipe connected to a jet head is activated (704) to allow a pressurized stream to be directed through the cutting tool pipe, through the one or more channels of the panel, and out of the jet head near the bottom of the panel. The pressure of the pressurized stream is dependent, among other things, on the material composition of the ground matter. The pressurized stream from the cutting tool contacts the ground matter and affects ground matter to be easily extracted through the channels. In some embodiments, the affected ground matter is wetted by a pressurized stream. In other embodiments, the ground matter is broken up with highly pressurized air without stream or moisture. In other embodiments, the ground matter is affected by a combination of a liquid and air.

The affected ground matter is then extracted from the ground by vacuum pressure (706) simultaneously or shortly after the pressurized stream is delivered. As the affected ground matter is removed through the panel, the panel, with the assistance of gravity, is automatically lowered into the ground matter (708). The cutting tool operates to lower the panel until the panel reaches the desired depth in the ground.

In one embodiment, the method includes a step of causing the jet assembly unit to be positioned on a floor within an aperture in the panel, wherein the jet heads are positioned above the bottom of the panel. In another embodiment, the method includes directing at least one jet head to deliver the pressurized stream in the immediate vicinity of the panel walls to define the perimeter of the area to be cut beneath the panel.

In some embodiments, the panel can be fortified in the ground by applying bonding material into the channels of the panel. Where multiple panels are horizontally attached to each other, the panels to-be-installed can be oriented such that the interlocking features of the subsequent panels are aligned with the already installed panel(s). As stated above, two or more panels connected horizontally may be oriented at any angle with respect to one another. Upon the subsequent panels being installed, the panels are fortified. In addition, the interlocked panels are fortified and bound together by applying bonding material into the perforated cylindrical lock or other locking feature.

In an embodiment where multiple panels are vertically attached one over another. The panels to-be-installed are oriented such that the bottom portion of the subsequent panel is aligned with the top end of the already installed panel. The subsequent panels are lowered until the bottom end of the subsequent panel comes in contact with the top end of the previous panel. As stated above, the channels of both panels are aligned and in communication with one another. The attached panels are fortified by applying bonding material into the channels of the multiple panels to rigidly connect the panels to one another. It should be noted that panels may be attached both vertically as well as horizontally using the above methods to form a barrier wall system.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

The invention claimed is:

1. A barrier panel installation system, comprising:
a panel having a top, a bottom, a front face and a back face;
at least one channel within the panel which extends from the top to the bottom of the panel;
a jet assembly unit removably positioned in the channel, the jet assembly unit comprising:
at least one cutter tool pipe having a first and second end, the first end being adapted to connect to a pressurized stream source, the second end being connected to a jet head adapted to direct a pressurized stream from the pressurized stream source to affect ground matter, wherein the jet head is positioned proximal to the bottom of the panel; and
at least one vacuum manifold that is adapted to remove the affected ground matter simultaneously with the delivery of the pressurized stream to automatically lower the at least one panel into a ground; and
wherein the jet head is movable independent of the at least one vacuum manifold to selectively direct the pressurized stream.

2. The barrier panel system of claim 1 comprising a plurality of jets heads having a fixed configuration, the fixed configuration jet heads being positioned around the perimeter of the panel and directed toward the perimeter of the panel at an angle.

3. The barrier panel system of claim 2 wherein the fixed configuration jet heads are configured to define a perimeter of an area to be affected beneath the panel.

4. The barrier panel system of claim 3 wherein the perimeter is rectangular.

5. The barrier panel system of claim 1 further comprising at least one connector member which positions the at least one cutter tool pipe and the at least one vacuum manifold in the panel.

6. The barrier panel system of claim 1 wherein the at least one channel comprises a floor having an aperture, the floor being positioned above the bottom of the panel, wherein at least one cutter tool pipe extends beyond the floor through the aperture, the jet head connected to the at least one cutter tool pipe positioned beneath the floor.

7. The barrier panel system of claim 6 further comprising at least one connector member which is a flat platform, wherein the flat platform connector member is positioned on the floor of the panel.

8. The barrier panel system of claim 1 wherein the panel includes a side attachment member and a corresponding side mating member, wherein the side attachment member comprises side walls which taper at an angle toward a cylindrical lock and the side mating member comprises side walls which taper at an angle toward a notched configuration.

9. The barrier panel system of claim 8, the cylindrical lock further comprising a top aperture and side perforations.

10. The method of claim 1 wherein the at least one cutter tool pipe, the jet head and the vacuum manifold are movable relative to the panel.

11. A barrier panel system comprising:
a panel having a top, a bottom, a front face and a back face;
at least one channel within the panel which extends from the top to the bottom of the panel;
a jet assembly unit removably positioned in the channel, the jet assembly unit comprising:
at least one cutter tool pipe having a first and second end, the first end being adapted to connect to a pressurized stream source, the second end being connected to a jet head adapted to direct a pressurized stream from the pressurized stream source to affect ground matter,
wherein the jet head is positioned proximal to the bottom of the panel, and
wherein the jet head is rotatable about a central axis transverse to the longitudinal axis of the cutter tool pipe; and
at least one vacuum manifold adapted to remove ground matter affected by the pressurized stream.

12. A barrier panel system comprising:
a panel having a top, a bottom, a front face and a back face;
at least one channel within the panel which extends from the top to the bottom of the panel;
a jet assembly unit removably positioned in the channel, the jet assembly unit comprising:
at least one cutter tool pipe having a first and second end, the first end being adapted to connect to a pressurized stream source, the second end being connected to a jet head adapted to direct a pressurized stream from the pressurized stream source to affect ground matter,
wherein the jet head is positioned proximal to the bottom of the panel, and
wherein the at least one cutter tool pipe is adapted to be mechanically oscillated back and forth about a longitudinal axis of the at least one cutter tool pipe; and
at least one vacuum manifold adapted to remove ground matter affected by the pressurized stream.

13. A jet assembly unit used to cut and remove ground matter, comprising:
at least one cutter tool pipe having a first and second end, the first end being adapted to connect to a pressurized stream source, the second end being connected to a jet head which is adapted to direct a pressurized stream from the pressurized stream source to affect ground matter;
at least one vacuum manifold that is adapted to remove the affected ground matter simultaneously with the delivery of the pressurized stream;
wherein the jet head is movable independent of the at least one vacuum manifold to selectively direct the pressurized stream; and
at least one connector member which connects the at least one cutter tool pipe and the at least one vacuum manifold to each other, wherein at least one connector member is adapted to removably position the at least one cutter tool pipe and the at least one vacuum manifold within a panel.

14. The jet assembly unit of claim 13 wherein the jet head is rotatable about a central axis transverse to the longitudinal axis of the cutter tool pipe as the pressurized stream is delivered.

15. The jet assembly unit of claim 13 comprising a plurality of jet heads having a fixed configuration, the fixed configuration jet heads being positioned to define a perimeter of an area being affected beneath the jet assembly unit.

16. The jet assembly unit of claim 15 wherein the perimeter is rectangular.

17. A jet assembly unit useable to cut and remove ground matter, comprising:

at least one cutter tool pipe having a first and second end, the first end being adapted to connect to a pressurized stream source, the second end being connected to a jet head which is adapted to direct a pressurized stream from the pressurized stream source to affect ground matter;

wherein the at least one cutter tool pipe is adapted to be mechanically oscillated back and forth about a central axis while delivering the pressurized stream;

at least one vacuum manifold adapted to remove ground matter affected by the pressurized stream; and at least one connector member which connects the at least one cutter tool pipe and the at least one vacuum manifold to each other, wherein at least one connector member is adapted to removably position the at least one cutter tool pipe and the at least one vacuum manifold within a panel.

18. A jet assembly unit useable to cut and remove ground matter, comprising:

at least one cutter tool pipe having a first and second end, the first end being adapted to connect to a pressurized stream source, the second end being connected to a jet head which is adapted to direct a pressurized stream from the pressurized stream source to affect ground matter;

at least one vacuum manifold adapted to remove ground matter affected by the pressurized stream; and at least one connector member which connects the at least one cutter tool pipe and the at least one vacuum manifold to each other, wherein at least one connector member is adapted to removably position the at least one cutter tool pipe and the at least one vacuum manifold within a panel;

wherein the at least one connector member is a flat platform which is adapted to engage a floor having an aperture within a channel of the panel.

19. A method of installing a panel in a barrier panel system, comprising:

a. in any order:

1. positioning a jet assembly unit within a channel of the panel, the jet assembly unit including at least one cutting tool pipe connected to a jet head and a vacuum manifold, wherein the jet head is positioned proximal to a bottom of the panel; and 2. positioning the panel over an area of installation;

b. affecting ground matter at the area of installation by directing a pressurized stream through the at least one cutting tool pipe and out of the jet head proximal to the bottom of the panel;

c. moving the jet head independent of the panel and the vacuum manifold to increase ground matter affected by the pressurized stream;

d. removing the affected ground matter with the vacuum manifold to form an opening at the area of installation;

wherein steps b and d are performed simultaneously; and e. lowering the panel into the opening.

20. The method of claim 19 comprising directing the jet head to deliver the pressurized stream in the immediate vicinity of the panel walls to define a perimeter of an area to be cut beneath the panel.

21. A method of installing a panel in a barrier panel system, comprising:

a. in any order:

1. positioning a jet assembly unit within a channel of the panel, the jet assembly unit including at least one cutting tool pipe connected to a jet head and a vacuum manifold, wherein the jet head is positioned proximal to a bottom of the panel; and 2. positioning the panel over an area of installation;

b. causing the jet assembly unit to be positioned on a floor within an aperture in the panel, wherein the jet head is positioned above the bottom of the panel c. affecting ground matter at the area of installation by directing a pressurized stream through the at least one cutting tool pipe and out of the jet head proximal to the bottom of the panel and in the vicinity of walls of the panel to define a perimeter of an opening at the area of installation beneath the panel;

d. removing the affected ground matter with the vacuum manifold to form the opening at the area of installation;

wherein steps c and d are performed simultaneously; and e. lowering the panel into the opening.

* * * * *